US005873340A

United States Patent [19]

Shifflette

[11] Patent Number: 5,873,340

[45] Date of Patent: Feb. 23, 1999

[54] SPARK PLUG FOR VENTING EXCESSIVE PRESSURE

[76] Inventor: J. Michael Shifflette, 5900 SW. 196th La., Fort Lauderdale, Fla. 33332

[21] Appl. No.: 976,531

[22] Filed: Nov. 21, 1997

Related U.S. Application Data

[63] Continuation of Ser. No. 810,267, Mar. 3, 1997.

[51] Int. Cl.[6] ..... F02P 1/00; F02B 77/00

[52] U.S. Cl. ..... 123/169 R; 123/198 D; 123/169 V

[58] Field of Search ..... 123/169 R, 198 D, 123/169 V; 137/540

[56] References Cited

U.S. PATENT DOCUMENTS

| | | | |
|---|---|---|---|
| 1,429,017 | 9/1922 | Cartmill | 123/169 V |
| 2,020,965 | 11/1935 | Rohde | 123/169 R |
| 3,079,453 | 2/1963 | Clark | 123/169 V |
| 4,553,559 | 11/1985 | Short | 277/552 |
| 4,699,096 | 10/1987 | Phillips | 123/169 V |
| 4,823,746 | 4/1989 | Kaplan | 123/169 V |
| 5,186,132 | 2/1993 | Runge | 123/169 R |
| 5,706,847 | 1/1998 | Strait et al. | 123/169 R |

*Primary Examiner*—Thomas N. Moulis
*Attorney, Agent, or Firm*—Malin, Haley, DiMaggio & Crosby, P.A.

[57] ABSTRACT

An internal combustion engine spark plug provides an overpressure release mechanism to avert engine component damage as a result of hydrostatic lock caused by liquids (typically water) entering the combustion chamber under operating conditions. This spark plug incorporates predictably and adjustably weakened structural zones such that, upon encountering overpressure situations, the central portion of the plug is ejected, generating sufficient flow area to expel gasses and liquids from the combustion chamber and venting the cylinder to the atmosphere. The invention is also useful in the detection and avoidance of damage under conditions of detonation.

16 Claims, 15 Drawing Sheets

SPARK PLUG FOR VENTING EXCESSIVE PRESSURE

This is a continuation of copending application Ser. No. 08/810,267 filed on Mar. 3, 1997.

BACKGROUND OF THE INVENTION

This invention relates to an engine spark plug which incorporates one or more weakened structural zones designed to rupture under operating conditions of extreme cylinder pressure, thereby providing a large air passage out of the cylinder to quickly vent liquid and air from the cylinder and avert conditions that could cause internal engine damage.

The four-stroke cycle internal combustion engine has long been vulnerable to the often disastrous effects of ingesting water into the combustion chamber during engine operation. Water which passes through the induction system (air box, filter, carburetor/airflow sensor, intake manifold) of an internal combustion engine enters the cylinder during the intake stroke. During the next compression stroke sufficient quantities of this water, which is effectively incompressible, will cause an increase in cylinder pressure well above ordinary operating pressures, until one or more engine components fail. Typical component failures include bent, broken, or holed pistons, piston pins, connecting rods, crankshafts, rod or crank bearings, cracked cylinder heads, cracked blocks or blown head gaskets. The result of such failures is either to vent the compressed cylinder contents to a region of lower pressure, deform the cylinder, or halt the piston's upward travel. This phenomenon is known as hydrostatic lock, hydrolock, or hydraulic lock, all referring to the condition in which liquids ingested into a running engine cause the engine instantly to stop, often accompanied by one or more of the aforementioned failures.

Certain applications of internal combustion engines are more susceptible to hydrolock than others. Off-road vehicles, such as 4 wheel drive trucks, all terrain vehicles and motorcycles, watercraft, and even passenger cars passing through standing water or flood waters are at risk. Hydrolock related repairs to the engines of such vehicles are enormously expensive, often costing thousands of dollars to repair. It would therefore be advantageous to design an engine or engine component which releases trapped liquids before hydrolock related damage occurs.

A similar, but generally less catastrophic condition, is the incidence of detonation in which, for any one of a number of reasons, the fuel-air mixture in the cylinder fails to ignite or burn properly and causes excessive pressure in the cylinder, often accompanied by a distinctive "ping."

Combustion in ordinary internal combustion engine is characterized by a flame front propagating roughly hemispherically away from the ignition source (the spark). As the flame front propagates, it produces a continuing increase in cylinder pressure, effectively driving the piston downward and producing torque on the crankshaft. Detonation is the phenomenon of spontaneous combustion of the fuel-air mixture, generating a nearly instantaneous shock (pressure) wave throughout the cylinder and precluding the continual generation of pressure associated with a normally propagating flame front. Detonation may occur silently or audibly, and may be severe or mild. Severe detonation may melt, crack, or hole pistons and other top cylinder or crankcase components in a matter of seconds.

Earlier inventions provide for the avoidance of damage due to detonation by employing a poppet-style valve to react to the pressure wave of ensuing detonation. However, while a poppet valve may be effective in attenuating the magnitude of the shock wave which accompanies detonation, it does nothing to remedy the condition. At the end of each detonating cycle the cylinder purges and replenishes itself to repeat the phenomenon the next cycle. The thermomechanical shock to the cylinder and cylinder components accompanying the deployment of the detonation "prevention" valve or spark plug is attenuated to the degree that imminent component failure is temporarily avoided. However, the onset and, more importantly to the engine tuner, the cause of detonation have not been identified nor addressed. In multi-cylinder applications, the spark plug of the detonating cylinder does not readily reveal itself so that investigation into detonation in that particular cylinder may be specifically investigated. Given that detonation may be silent, and is capable of imparting severe damage in a short period of time in a highly tuned engine (such as a racing application), it is important that detonation be discovered, and its cause remedied, as early as possible.

Both hydrolock and detonation are deleterious to engine operation, and both are inexpensively remediable if discovered and treated prior to engine failure. The spark plug of this invention is designed to avert engine failure caused by hydrolock or detonation by venting excessive pressure out of an affected cylinder before the pressure becomes so great as to cause other engine components to fail.

The two-stroke cycle internal combustion engine presents a decreased potential to hydrolock. The decreased potential is chiefly due to the entry of the fuel-air mixture into the crankcase prior to admission into the cylinder. The compression ratio of the mixture in the crankcase (the primary chamber) is far lower than the compression ration in the cylinder (the secondary chamber). This permits a comparatively large amount of water to enter a two-stroke cycle engine without immediate damage. Water in the crankcase does not enter the cylinder immediately, as the transfer port tends to take air from the top of the crankcase rather than water from the bottom (assuming a cylinder-up orientation during the stroke in which water was ingested). The water-laden fuel-air mixture is unlikely to fire, leading to engine shut down due to lack of ignition and combustion. Nevertheless, there is a danger that hydrolock will be severe enough to cause the failure of engine components, requiring major repairs to restore the engine to an operable condition.

The present invention is a modification of a typical internal combustion engine spark plug, which employs all of the technology and features of ordinary spark plugs in terms of application, heat ranges, radio interference suppression, and functions identically to ordinary plugs under normal operating conditions. Upon the development of excessive cylinder pressures, however, the spark plug permanently deforms or disintegrates, generating a passage suitably large to permit the expulsion of gasses or liquids to prevent engine damage. Upon deformation or disintegration the spark plug will no longer form an airtight seal, and replacement of the spark plug must be performed.

OBJECTS OF THE INVENTION

It is an object of the present invention to provide a means of venting air and liquids from an internal combustion engine to prevent the occurrence of hydrostatic lock.

It is another object of the invention to adapt a conventional spark plug to release and eject the central portion of the plug to present a large passageway for the expulsion of trapped liquids and gasses, averting the impending hydrolock condition.

It is a further object of the present invention to adapt a spark plug with weakened structural zones to rupture to vent deleterious over pressures, such as those caused by the condition known as detonation or preignition, to continuously and partially vent that cylinder, entirely preventing further detonation, until the cause may be identified and corrected, and the spark plug replaced.

It is another object of the present invention to combine in a spark plug multiple stage release mechanisms to generate a constricted passage, by component rupture, to continuously, vent detonation-accompanied overpressure, and to further release and eject the central plug components to provide a large, unrestricted passage for the expulsion of liquids and gasses under impending hydrolock conditions.

SUMMARY OF THE INVENTION

An internal combustion engine spark plug provides an overpressure release mechanism to avert engine component damage as a result of hydrostatic lock caused by liquids (typically water) entering the combustion chamber under operating conditions, or as a result of detonation. This spark plug incorporates predictably and adjustably weakened structural zones that, upon encountering overpressure situations, will result in a rupture of the sidewall of the spark plug or in the ejection of the central portion of the plug, generating sufficient flow area to expel gasses and liquids from the combustion chamber and venting the cylinder to the atmosphere.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF PREFERRED EMBODIMENTS

Figure 1:
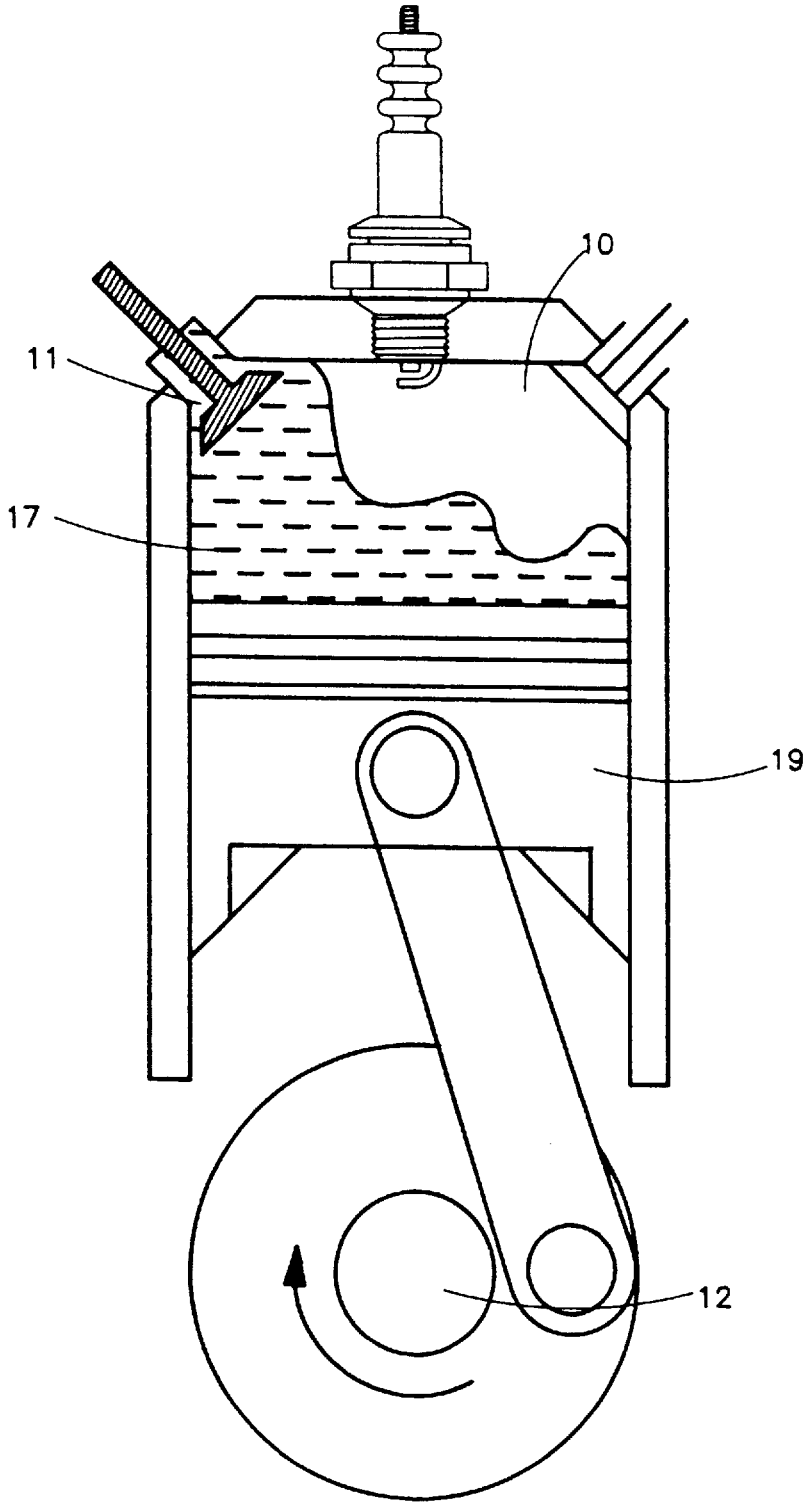
FIG. 1 diagrammatically illustrates the spark plug of this invention, cylinder, piston and rod, and crankshaft of an internal combustion engine showing the ingestion of water through the intake valve during the intake stroke of the engine.
Figure 2:
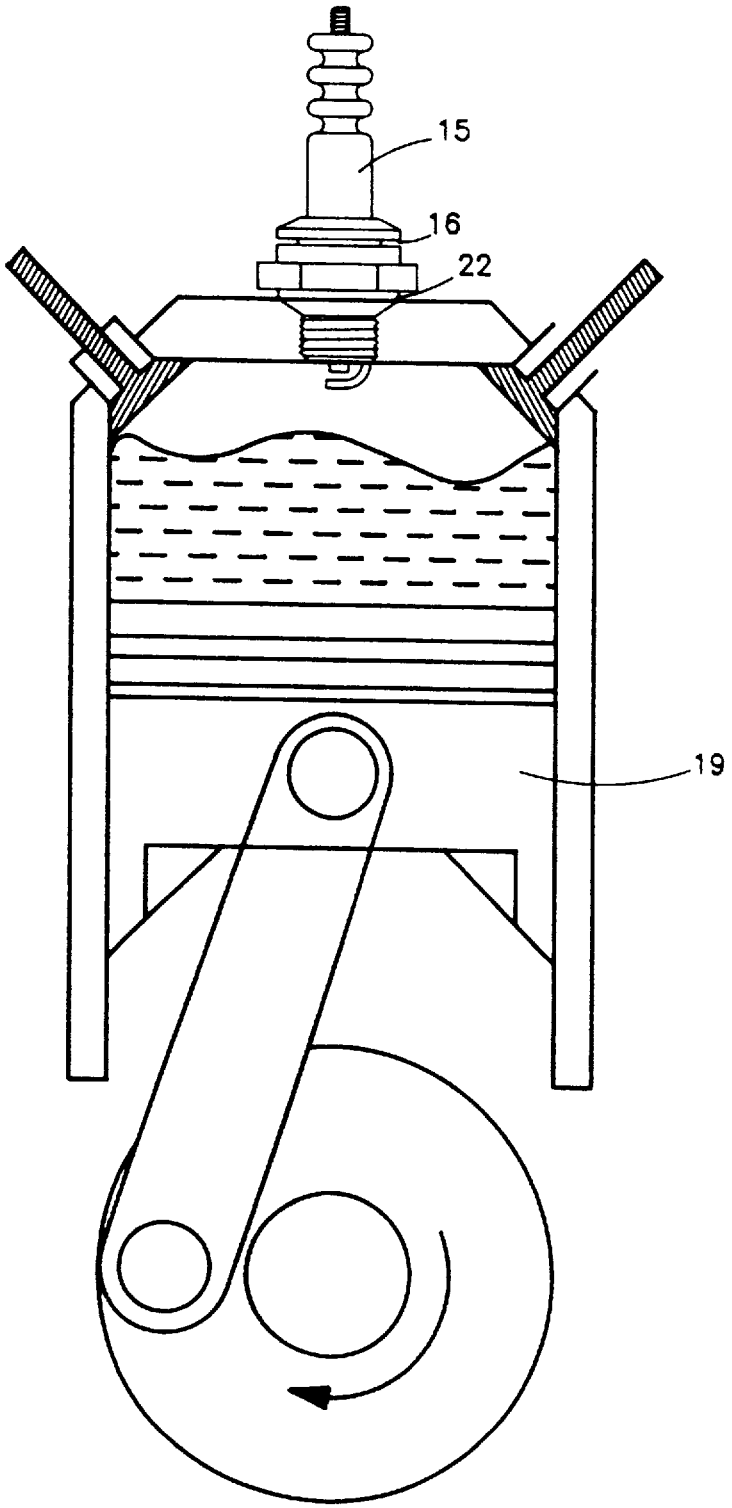
FIG. 2 diagrammatically illustrates the spark plug, cylinder, piston, rod and crankshaft assembly of an internal combustion engine midway through the compression stroke of the piston. The piston is approaching the point at which hydrostatic lock will cause upward piston motion to cease, resulting in damage to the engine.

As shown in FIG. 1, water or some other liquid 17 may be ingested into an engine cylinder 10 through the intake port 11 during rotation of the crank shaft 12 and downward movement of the piston 19 on the intake stroke. In FIG. 2, a spark plug 15 having a groove 16 about the housing 22 is designed to form a permanent air passage through the housing upon encountering excessive cylinder pressures developed due to hydrolock as the piston 19 traverses upward.

Figure 3:
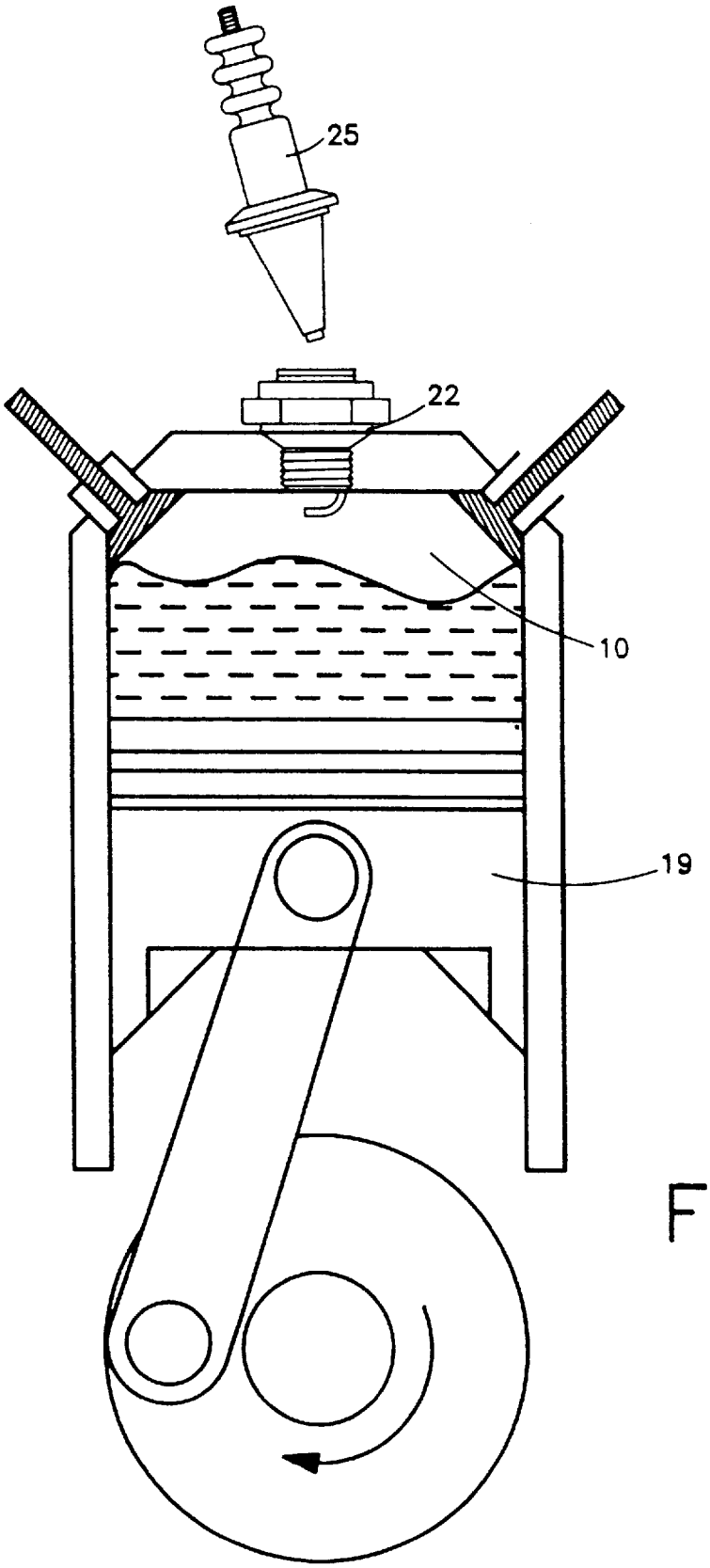
FIG. 3 diagrammatically illustrates an engine cylinder experiencing extreme internal pressure due to the presence of water in which the central portion of the spark plug is being ejected to form a permanent air passage to release cylinder pressure.

With the further upward movement of the piston 19, and corresponding reduction in cylinder volume 10, pressure builds to a point at which the top portion of the spark plug body 25 is released from spark plug housing 22 and is ejected from the cylinder, as shown in FIG. 3.

The structurally weakened area, which shall be referred to as the joint, generally consists of the thinnest part of the sidewall which is formed by placing a groove circumferentially around the outer perimeter of the spark plug housing. The location of the joint below or above the internal housing seal will generally determine the failure mode of the spark plug.

Figure 4B:
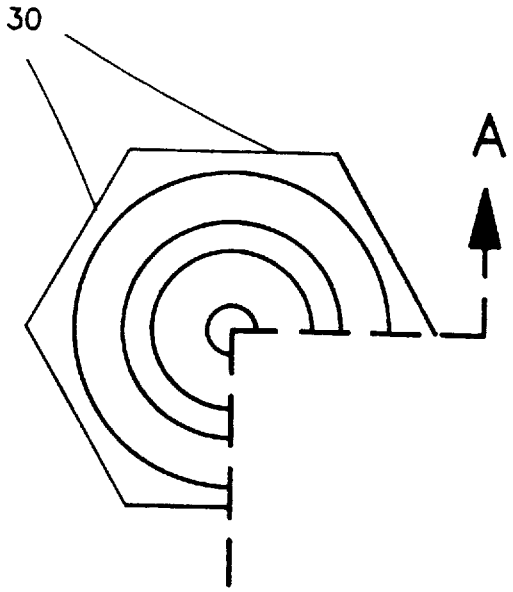
FIG. 4*b* diagrammatically illustrates a plan view of the spark plug showing the line of cutaway view of FIG. 4*a*.
Figure 4A:
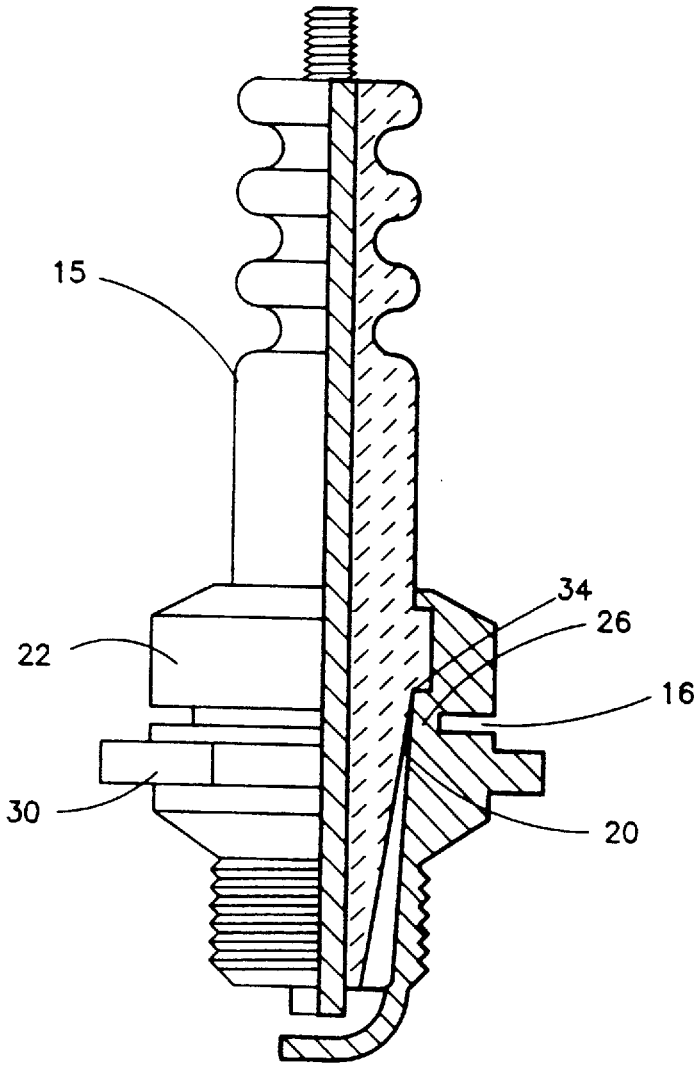
FIG. 4*a* diagrammatically illustrates the spark plug of the invention in partial cutaway view.
Figure 5:
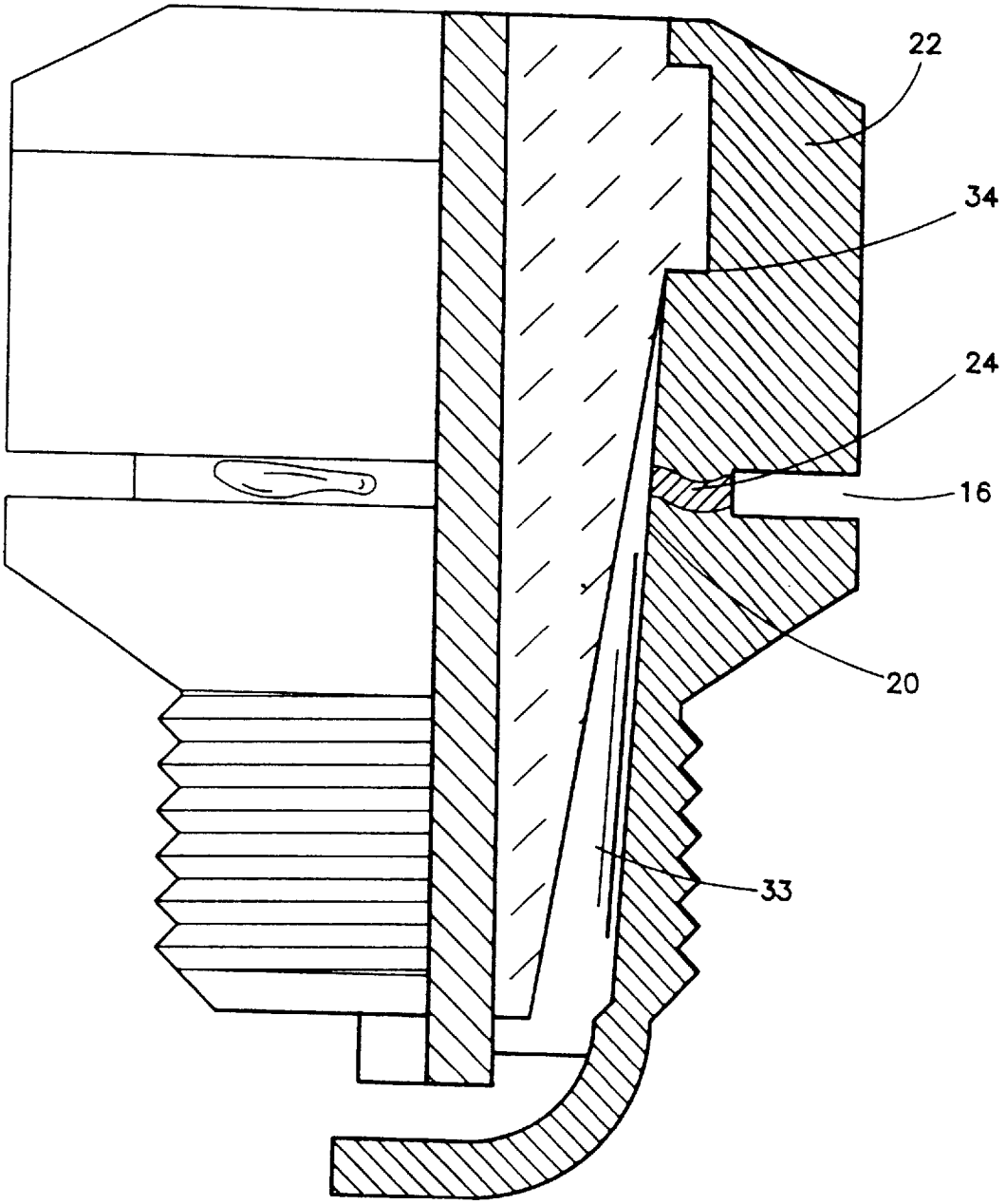
FIG. 5 diagrammatically illustrates a failure mode for the spark plug showing the forming of an air passage upon the ejection of the central portion of the spark plug.

In its simplest embodiment, as depicted in FIG. 4*a*, a spark plug 15 is selectively weakened at the sidewall 20 of the spark plug housing 22. A top view of the spark plug showing the hex flats 30 and the cutaway viewing area is shown in FIG. 4*b*. In this embodiment, the groove 16 lies below internal seal 34. Upon encountering excess cylinder pressure, sidewall 20 will experience radial stresses induced by pressure upon the internal face of the housing wall, and tensile stress caused by upward force against the internal insulator. The structural configuration of the area that includes the groove 16 and the adjacent housing wall located radially inward from the groove will be referred to as the joint 26. As shown in FIG. 5, combined tensile and radial stresses set up a nearly bi-axial state of stress in the joint which, as pressure builds to a predetermined level, will cause the joint to fail, opening an air passage 24 from cavity 33 through sidewall 20 to ambient air. By locating groove 16 below internal seal 34, internal sidewall 20 is directly exposed to cylinder pressure, thus facilitating rupture due to radial pressures applied directly against the sidewall. Sidewall rupture can be extensive or minimal, depending upon the maximum pressure experienced. Upon experiencing pressures of limited predetermined magnitude, such as would occur in conditions of detonation, the spark plug will experience a minor rupture of the sidewall that can thereafter be used to locate the affected cylinder. If greater pressure is experienced, a larger rupture, or complete separation of the central portion of the spark plug will occur. Because the sidewall is sensitive to radial stress caused by moderate conditions of excessive pressure, this embodiment is particularly well suited to abate conditions of detonation.

Figure 6:
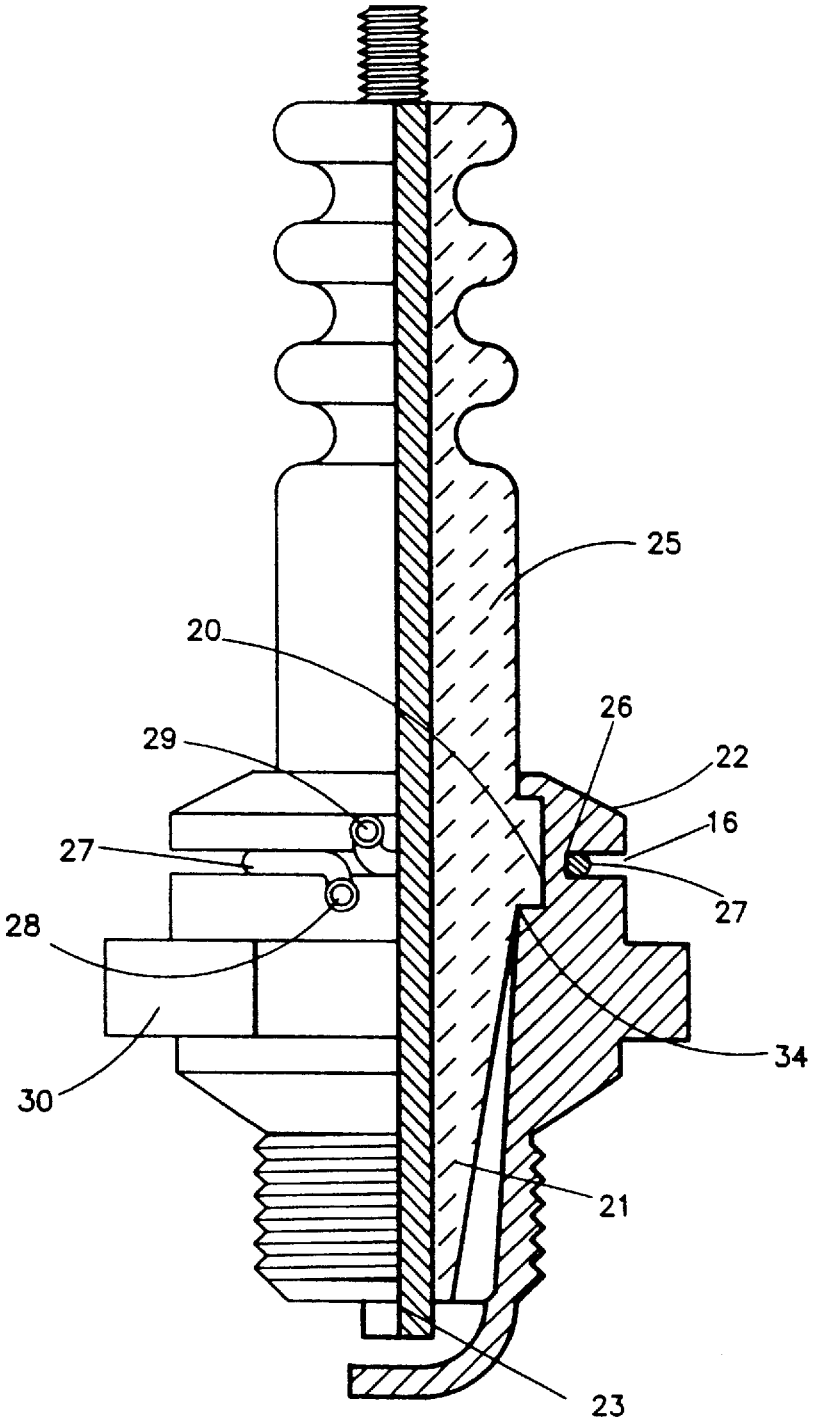
FIG. 6 diagrammatically illustrates the spark plug of the invention having a retention cable wound within the groove in the housing in partial cutaway view.
Figure 7:
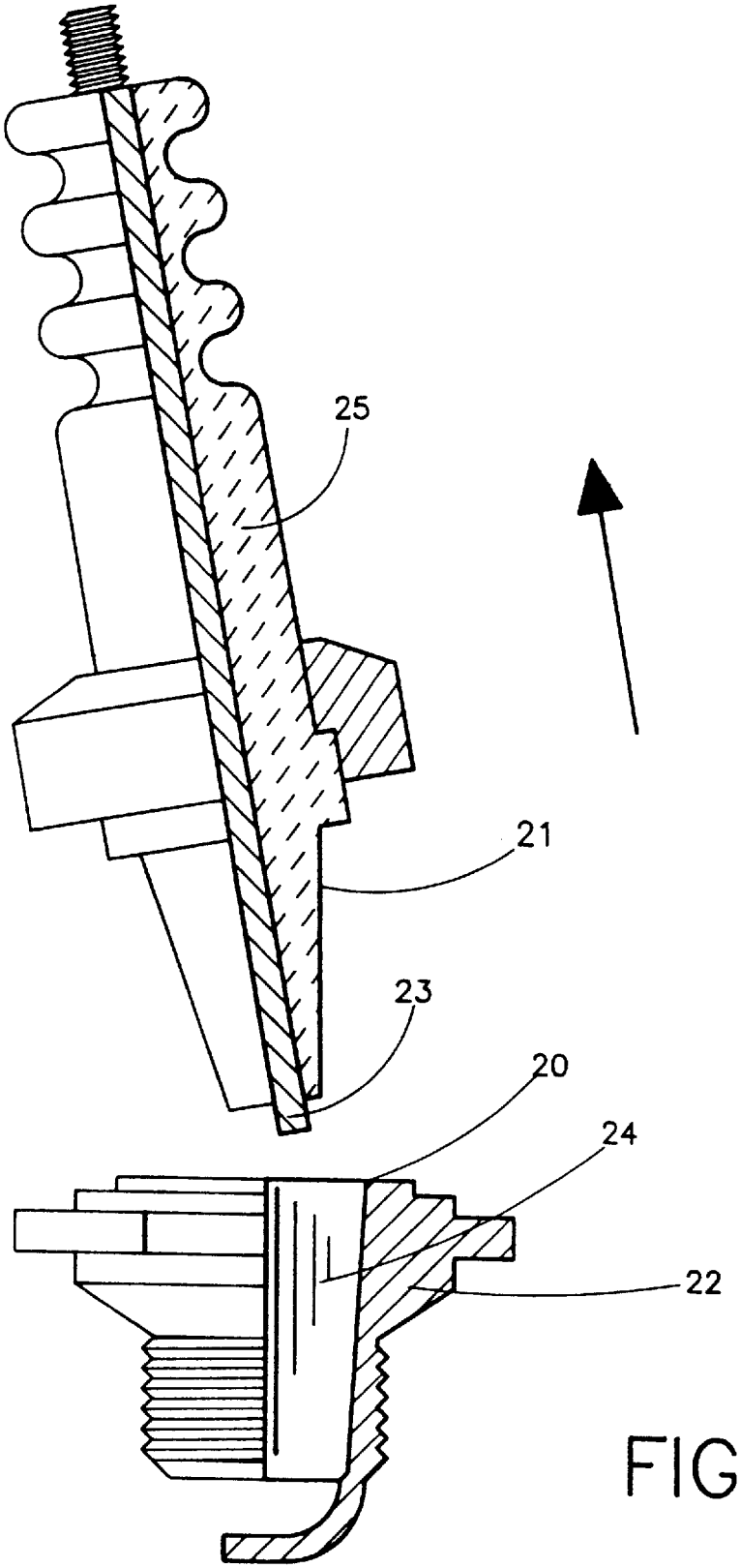
FIG. 7 is a partial cutaway view showing a failure mode in which the central part has broken away from the lower housing creating an air passage through the lower housing.

Another embodiment of the invention depicted at FIG. 6 employs external groove 16 in the upper portion of spark plug housing 22. The groove, which resembles an o-ring land, reduces the structural cross sectional area of the housing wall 20, which in turn lowers the amount of tensile loading that joint 26 may endure prior to tensile failure. Locating joint 26 at or slightly above the insulator/body seal 34 does not expose the weakened region to direct combustion pressures. Rather, combustion pressures acting upon insulator 21 and center electrode 23, generate a net upward axial force, tending to break the joint 26 and expel the top portion of the plug body 25, as shown in FIG. 7. By locating joint 26 above insulator/body seal 34, the joint will be exposed solely to tensile stresses, effecting straightforward calculation of the pressure corresponding to the tensile stress joint failure.

As shown in FIG. 6, a wire or cable 27 may be conveniently wrapped around the plug body, residing within the groove 16, and having opposite ends of the wire 28 and 29 secured to opposite sides of the groove. Upon release and ejection of the top portion of the plug body 25, the wire 27 will unfurl, allowing complete disengagement of top portion 25, while restraining the ejected components from traveling more than a few centimeters from the cylinder head. The potential for the forcibly ejected top portion, moving at a high uncontrolled velocity, to contact and inadvertently cause damage to components external to the spark plug, is thus substantially eliminated. The hex flats 30 for spark plug wrench engagement in FIG. 6 are located below the joint 26 in order to facilitate installation and removal of the lower body portion of the spark plug from the engine without placing undue stress upon the weakened areas. This is particularly necessary for the embodiment shown in FIG. 6, since hex flats will be required on the remaining lower body portion in the cylinder head to facilitate removal following a total separation. By locating hex flats beneath the weakened region, one may apply tightening torque to the spark plug to insert the plug in the head without transmitting torque through the weakened region which could result in the premature failure of the weakened region.

The failure mode of the spark plug depicted in FIG. 6 is demonstrated in FIG. 7 in which sidewall 20 has undergone tensile failure from excessive cylinder pressure acting upwardly upon the internal faces of insulator 21 and electrode 23. In that failure mode, tensile stress-induced rupture causes a radial passage 24 to form which may extend partially or completely around the circumference of the plug body to vent cylinder contents. A complete rupture will cause insulator 21, ground electrode 23 and a portion of the body 25 external to the weakened zone to be forcibly ejected from the housing 22, generating a maximum vent passage 24. The relatively greater pressures required to trigger this failure mode make an upper groove embodiment particularly suitable for hydrolock related conditions.

Figure 8A:
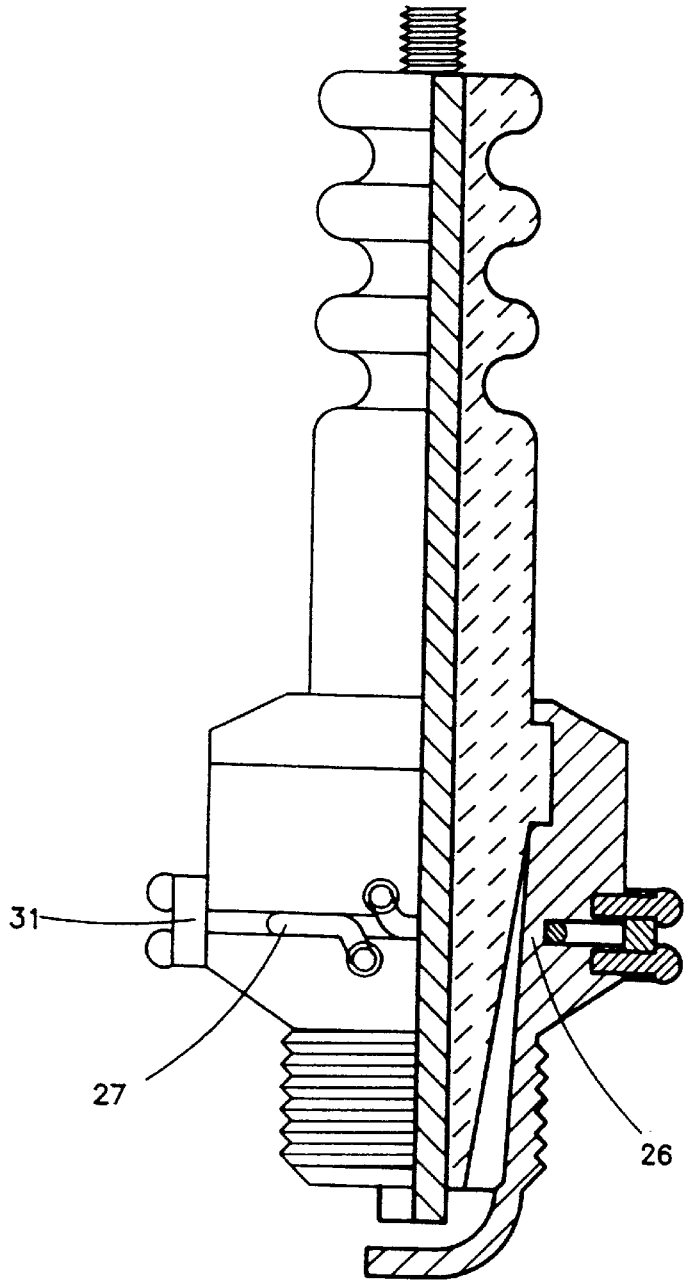
FIG. 8*a* diagrammatically illustrates the spark plug of the invention in partial cutaway view in which a cable is wound around the groove in the housing in which there are struts across the groove.
Figure 8B:
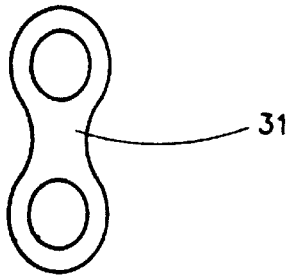
FIG. 8*b* shows a detailed view of a strut used with the spark plug.

A further embodiment, shown in FIG. 8*a*, permits a more precise selection of the pressure at which separation occurs by the employment of longitudinally positioned struts 31 across joint 26. FIG. 8*b* shows a detailed view of a strut 31. With the calculated weakening of the spark plug body, previously described, joint 26 may be structurally supplemented by external struts 31, connecting the regions separated by the weakening groove. In addition to a stress-free installation, these struts may be installed in tension or compression to axially preload the joint. In the case of the struts being applied in tension, the joint is axially preloaded in compression, effectively modifying the response of the joint to tensile and/or pressure stresses. Normal tensile stresses produced by ordinary combustion pressures may be partly or entirely offset by such tensile strut installation. Thus for a given groove dimension (dictating the cross sectional area under axial, radial or combined stresses) the entire joint may selectively spend its entire operational life in a state of axial compression or tension. Alternatively, the joint may be designed to cycle from compression through a short period of tension, though the magnitude of the tensile stress is attenuated due to axial compressive preloading. In addition to axial preloading, the groove may be radially preloaded by the installation of restraining cable 27 under tension. The degree of applied tension will determine the point at which joint 26 will rupture.

Figure 9:
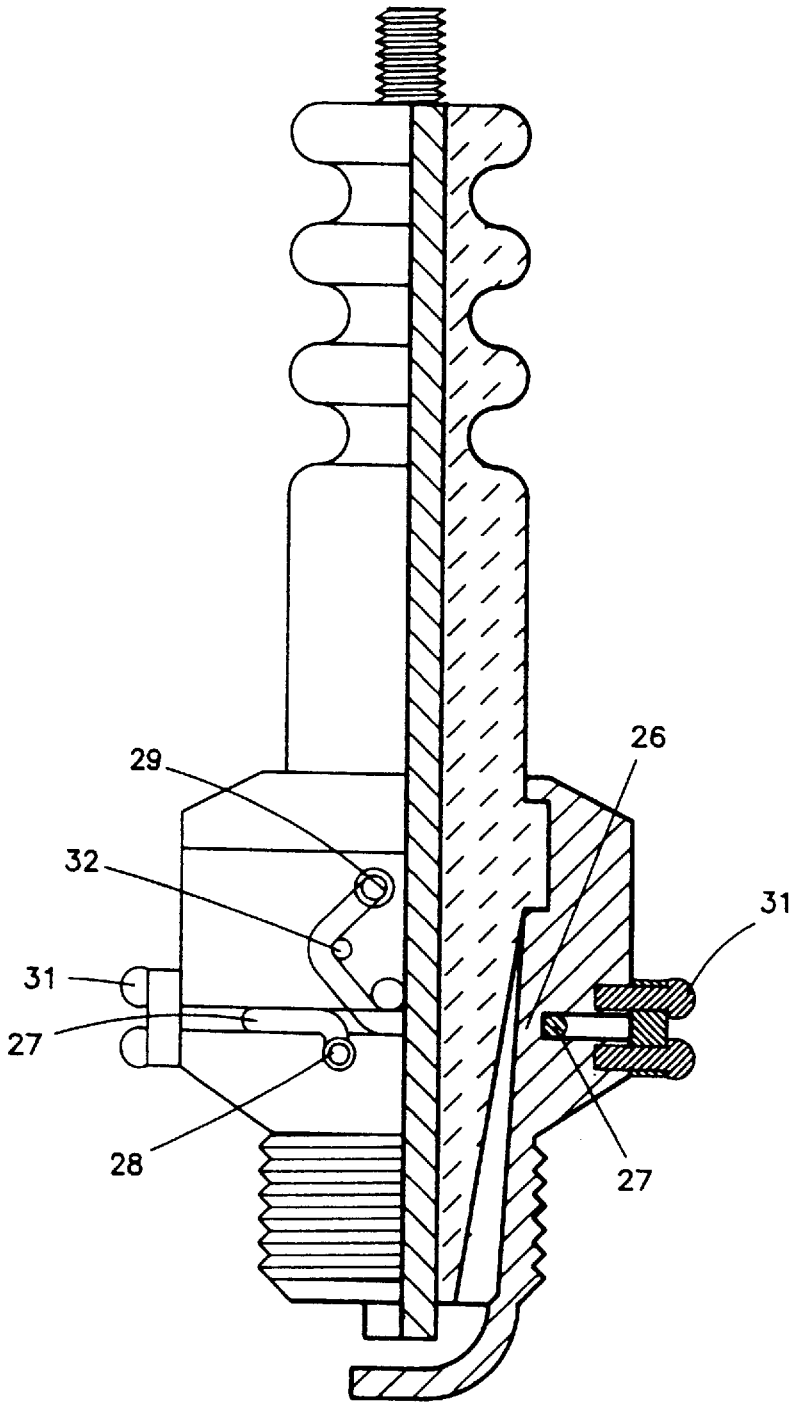
FIG. 9 diagrammatically illustrates a partial cutaway view of the spark plug having a cable within the groove and struts across the groove in which cable tension is adjustable by a cam pin located on the housing.
Figure 10:
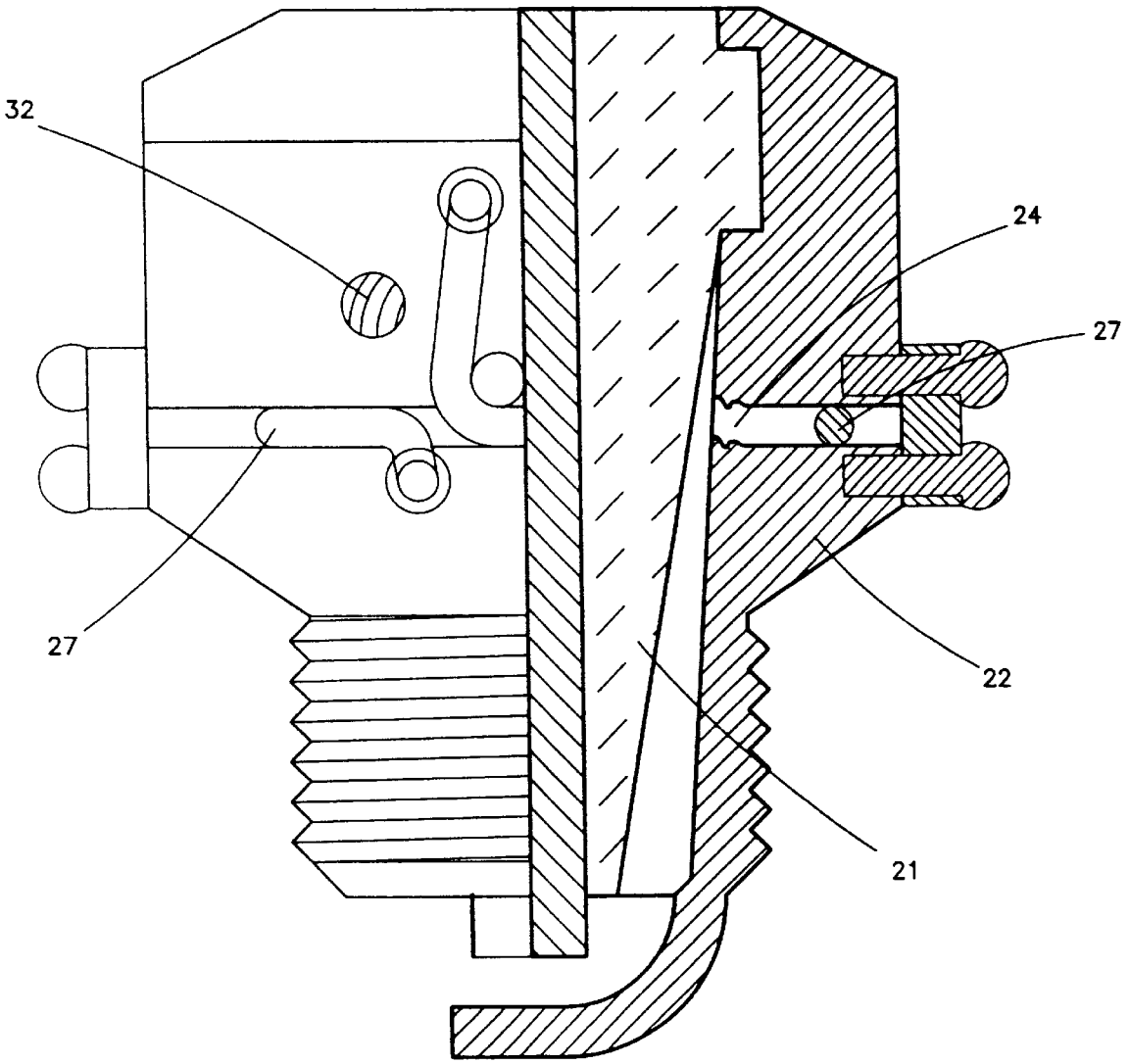
FIG. 10 diagrammatically illustrates a failure mode of the spark plug of the invention in which a rupture has created an air passage for venting of excessive cylinder pressure.

FIG. 9 depicts a detailed illustration of a joint 26 axially supported by struts 31 and radially supported by cable 27. A cable retention system passes around, and will dislodge from, a deformable support post 32, thus providing a visible indication that the retention cable 27 has been released. Replacing deformable support post 32 with a cam or eccentric pivot secured to the housing between the endpoints 28 and 29 of cable 27 will allow tightening or loosening of the cable by turning the cam, thereby permitting selection of the pressure at which the joint 26 will fail. As is depicted in FIG. 10, excessive pressure in the cavity between insulator 21 and housing 22 causes bulging of the housing wall within the joint, which in turn places additional tension upon cable 27, causing cam 32 to shear. The corresponding release of tension on cable 27 allows the cable to move away from the joint, thereby removing radial support and permitting the formation of air passage 24. The preload of the cable, and the selection of the breakaway force of the joint may be made field adjustable by the inclusion of an eccentric pivot of known shear strength, area, and shear force required to dislodge the cable or wire. The presence of a slacked cable signals that the vented spark plug has undergone radial failure, thus obviating the need to remove each spark plug in the engine for individual inspection for signs of venting.

Thus, the embodiment shown in FIG. 10 exhibits three independently adjustable variables to tailor the joint's response to detonation related and hydrolock related failure. Since factors related to joint failure are compounded by fatigue incurred over numerous spark plug firings, the existence of three independent means to adjust the joint's response provides a wide degree of control over conditions for which failure is programmed to occur.

Figure 11:
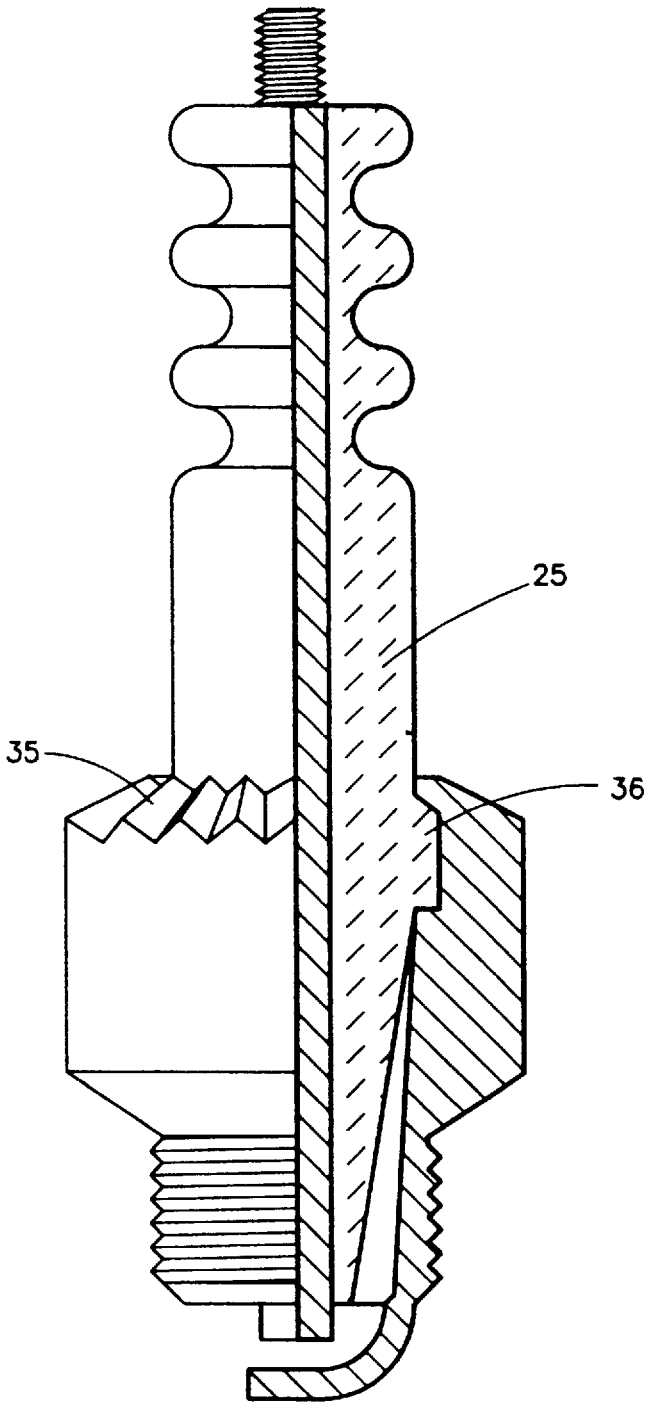
FIG. 11 diagrammatically illustrates an embodiment of the spark plug of the invention in which the weakened structural area is located at the uppermost portion of the housing.
Figure 12:
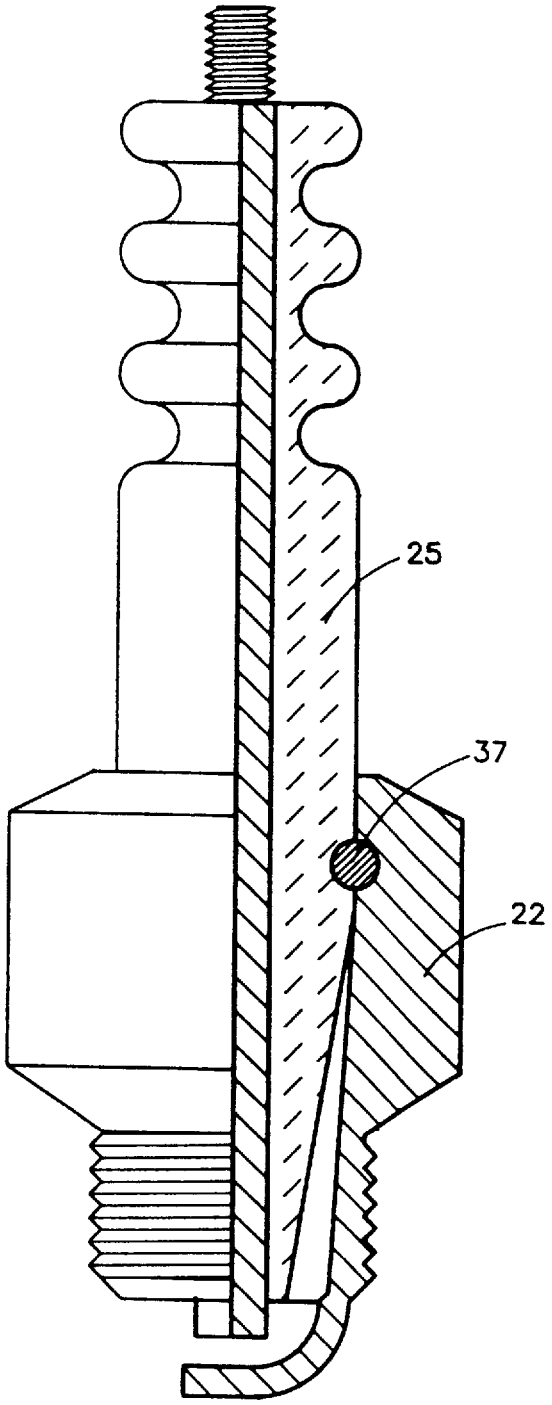
FIG. 12 diagrammatically illustrates a partial cutaway view in which the central portion of the spark plug is retained within the housing with a shear ring or clip.

The structural weakening of the spark plug has been described from an external modification standpoint, that of cutting a groove to decrease cross sectional load-bearing area to an application specific amount. The act of weakening the spark plug's structural integrity such that release will follow under undue pressure conditions may equally well be enacted from within, as is depicted in FIGS. 11 and 12. In FIG. 11, a specialized crimp 35 may be engineered to weaken the housing structure above and securing the enlarged portion of the insulator 36, thus permitting the release of the center portion of the plug 25. An alternative embodiment, shown in FIG. 12, employs a shear ring 37 that is engineered to release center portion 25 from housing 22 upon encountering predetermined cylinder pressure.

Figure 13A:
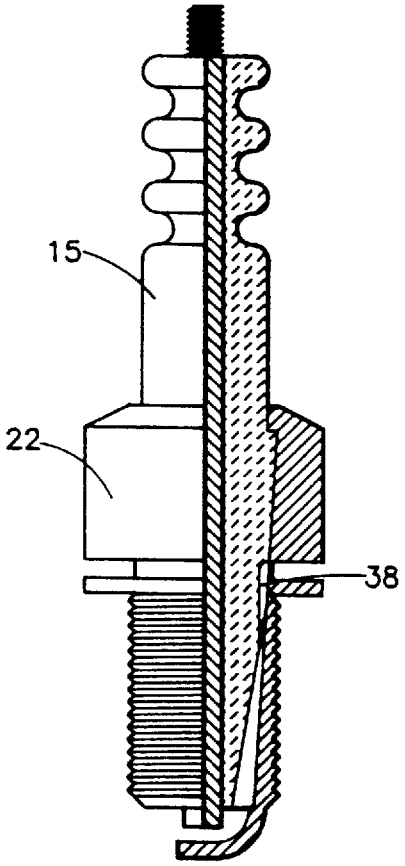
FIG. 13*a* diagrammatically illustrates a partial sectional view of the spark plug in which a port, or channel, is cut into the central portion to permit combustion chamber pressure to be communicated to an inner wall of the spark plug housing.
Figure 13B:
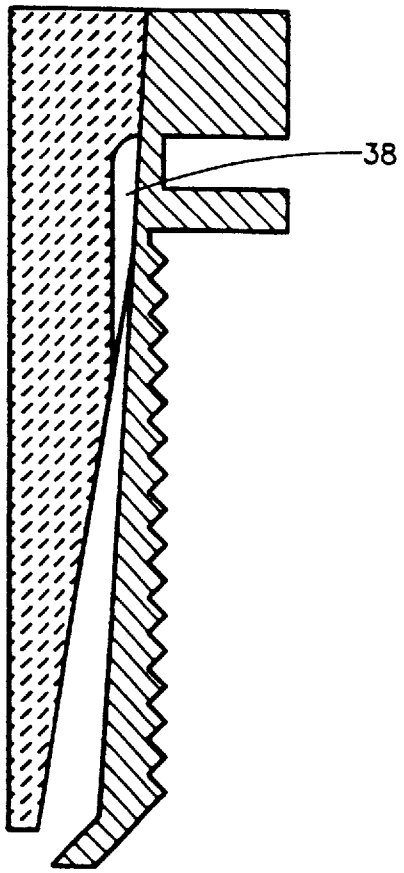
FIG. 13*b* diagrammatically illustrates an enlarged view of the lower portion of FIG. 13*a* in which the channel directs combustion pressure to the inner wall of the spark plug housing.

The failure mode of the spark plug can be further controlled by directing internal combustion pressure to a specific point on the inner wall of the housing by means of one or more ports provided for that purpose, as is depicted in FIGS. 13*a* and 13*b*. Port 38, consisting of a channel provided generally between the central portion of the plug 15 and housing 22 permits cylinder pressure to be experienced at inner housing wall 20 in the vicinity of the joint 26. The size, configuration, and location of port 38 can be used to direct pressure to a specific location upon the inner sidewall, thereby avoiding the necessity of providing a groove circumferentially around all or most of the housing. In this embodiment, weakened areas can be limited to those in the vicinity of port 38, and failure modes will be limited to radial rupture without physical loss of plug body 15.

The configuration of port 38 can be varied to produce attenuation or augmentation of pressure experienced at inner housing wall 22, as desired. Thus, for example, the port may be configured as a converging-diverging nozzle that would cause a subsonic shock wave to be accelerated to supersonic flow prior to encountering the housing sidewall. Conversely, a diverging-converging nozzle might be used to decelerate a supersonic shock wave prior to its impacting the housing sidewall. Obviously, converging only, or diverging only configurations may also be employed to achieve desired shock wave speed and impact characteristics.

Figure 14:
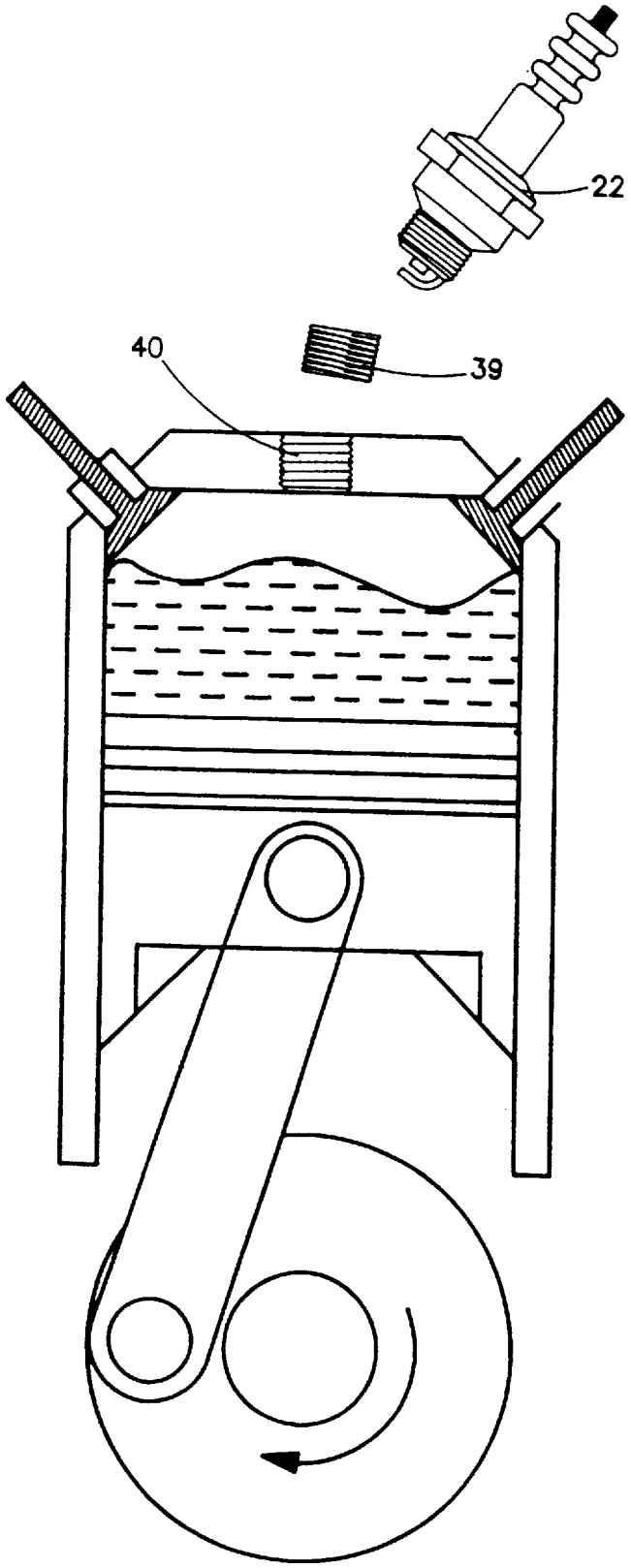
FIG. 14 diagrammatically illustrates a failure mode for the spark plug in which a helical spring inserted between the threads of a spark plug and a socket in the cylinder permits the entire spark plug to release upon encountering sufficient cylinder pressure.

The desired object of creating a permanent vent for cylinder pressure may also be obtained through the total release of the entire spark plug and housing upon encountering predetermined cylinder pressure. FIG. 14 depicts a configuration in which the threaded portion of the housing 22 is machined to a slightly smaller diameter than the corresponding threaded hold in the cylinder 40, and a helical coil 39 is wound around the spark plug threads or is inserted into the corresponding cylinder threads to complete an airtight seal when the spark plug is inserted and tightened into the cylinder. Helical coil 39 can be designed to fail upon encountering a predetermined amount of stress caused by internal cylinder pressure forcing the spark plug upwardly, at which point the spark plug can be completely released from the cylinder without other physical distortion of the spark plug. Modifications of this failure mode include the application of a fluid or gel hardening substance to the spark plug or cylinder threads prior to insertion of the spark plug, or a thread design configuration in which that portion of the threads that comes into contact with the corresponding cylinder threads is designed to fail upon predetermined loading conditions.

Figure 15:
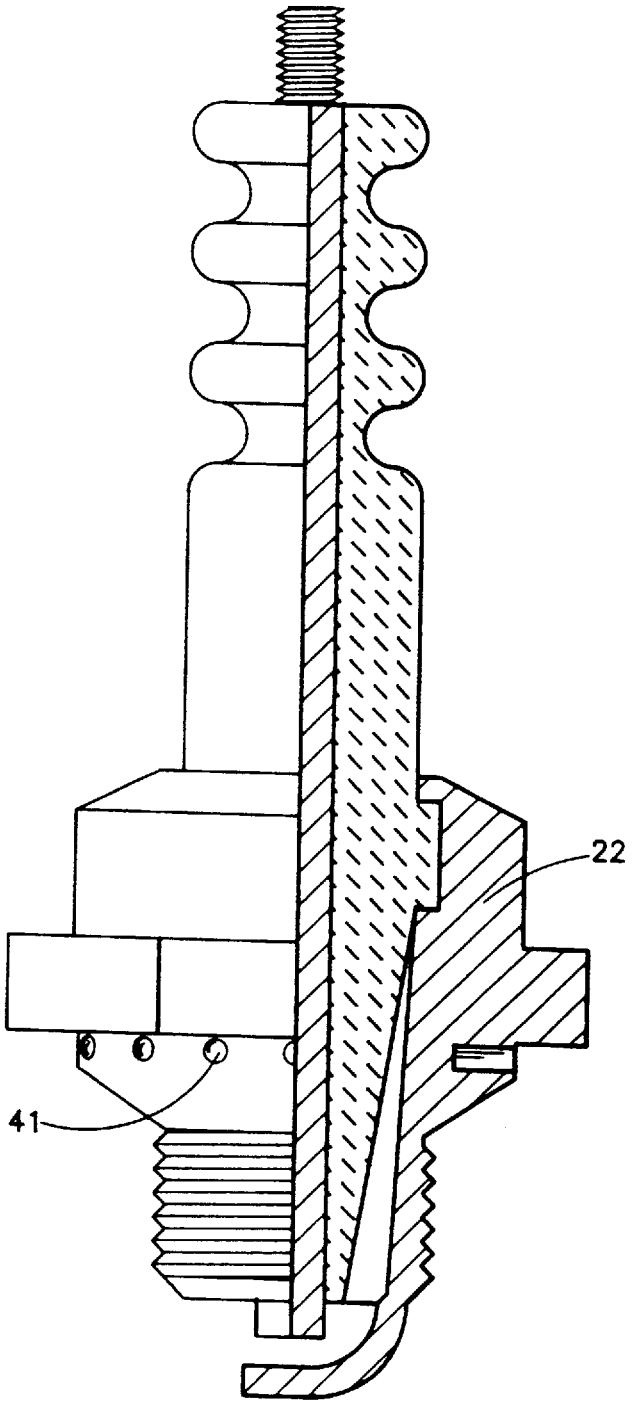
FIG. 15 diagrammatically illustrates the spark plug in cutaway view in which blind holes have been drilled into the housing to create weakened areas that will fail under predetermined cylinder pressures.

A further embodiment, shown in FIG. 15, consists of one or more blind holes 41 drilled partially into the lower portion of housing 22, to create a weakened sidewall in the vicinity of each blind hole. By varying the depth of each blind hole, hence the thickness of the housing between the blind hole and the inner housing wall, the pressure at which the sidewall will rupture may be controlled.

It will readily be appreciated that the failure modes described herein are suited to all types of internal combustion engines, regardless whether an actual spark producing device is used to detonate the fuel-air charge. For example, a glow plug used in a diesel engine could be modified as described herein, and would serve the purpose of preventing internal engine damage upon encountering overpressure conditions. Therefore, although a spark plug has been shown and described, it is to be understood that glow plugs for diesel engines, and other plugs that exist or may be created for insertion into combustion chambers, are equally suitable to carry out the objects of this invention, and the term spark plug, as used herein, is intended to include such other plugs.

In designing a spark plug as described herein, the accurate determination of peak pressures under a variety of conditions such as ordinary operation, highly loaded operation, detonation, and hydrolock, is of primary importance. Peak operating pressures of 800 psi to 900 psi are typically generated in a four-stroke cycle engine under normal conditions, while pressures of 1100 psi to 1200 psi may be experienced in an engine encountering detonation. A maximum pressure under hydrolock conditions which narrowly averts catastrophic failure of engine components is estimated to be approximately 2000 psi, although component failure is dependent upon specific engine design and construction.

As described herein, detonation occurs at lower peak pressures than hydrolock, and may be expected to occur on a continuing basis until the cause of detonation is removed or corrected or until repeated overpressures associated with detonation result in component failure.

The present invention provides for a more decisive prevention of detonation. The radial rupture shown in FIG. 9, caused by the shock and pressure stresses of detonation, provides a non-resetting, non-resealing vent to the atmosphere. This joint will leak at a rate dependent on pressure and vent passage area (roughly the area of the circumferential slice of material missing from the cylindrical wall). A cylinder, whether in a high performance state or not, will rarely, if ever, be able to achieve detonation conditions with even a mild cylinder leak. Further detonation is infallibly prevented with adequate leak rate. A drawback to the system under certain applications is that the cylinder having a controlled permanent orifice leak to avert detonation will perform quite modestly during the interim prior to spark plug replacement. The modestly performing cylinder will not, however, destroy itself. This is a desirable trade-off for high and ultra-high performance applications. It is important to note that prior to such venting, the plug is functionally and thermodynamically indistinguishable from ordinary spark plugs.

With extensive control of the joint's reaction to static and cyclical loading available through the invention, the engineer is capable of dictating with good precision the limits of cylinder pressure, and the accompanying failure modes to be employed to avert the causes and/or effects of overpressure. The same spark plug designed for use in ordinary passenger vehicles may be used for high performance applications. A spark plug set to prevent detonation only in extreme conditions may be adjusted solely to prevent hydrolock, or may be readjusted to prevent detonation under less extreme conditions. Such flexibility permits the manufacture and stocking of only a few spark plug types that may be adjusted to a variety of uses and conditions. It will be understood that the embodiments described and depicted herein are designed to illustrate the flexibility and ability to tailor the application of the invention to a variety of specific needs that will be identifiable to those skilled in the art. The claims appended hereto are meant to cover modifications and changes within the spirit and scope of the present invention.

What is claimed is:

1. A deformable spark plug for attachment to a cylinder of an internal combustion engine comprising:

a housing and a central portion;

said housing including a housing wall having an outer surface and an inner surface;

said outer surface including means for securing said housing to said engine cylinder;

said inner surface of said housing wall extending around and contacting said central portion to form an airtight seal between said inner surface and said central portion;

said inner surface and said central portion forming an airspace around said central portion below said airtight seal;

said airspace being in fluid communication with said engine cylinder to experience pressure substantially equal to pressure in said cylinder;

said housing wall including one or more selectively weakened areas above said securing means; and, said selectively weakened areas becoming permanently deformed to create an air passage through said housing above said securing means upon the introduction of a predetermined higher than normal operating pressure into said airspace whereby said predetermined higher than normal operating pressure is released to an area of relatively lower pressure, said predetermined higher than normal operating pressure falling within a range that is greater than normal operating pressure and lower than the pressure at which engine failure will occur.

2. A deformable spark plug as recited in claim 1 in which said selectively weakened areas comprise a groove located in said outer wall of said housing.

3. A deformable spark plug as recited in claim 2 in which said groove is circumferentially disposed around said housing.

4. A deformable spark plug as recited in claim 3 in which said groove comprises a channel having a rectangular shape.

5. A deformable spark plug as recited in claim 3 in which said groove comprises a channel having a rounded surface.

6. A deformable spark plug as recited in claim 2 in which a cable is located in said groove and extends circumferentially around at least a portion of said groove, one end of said cable and the other end of said cable being attached to said outer wall of said housing on opposite sides of said groove, said cable being selectably tensionable whereby said cable provides inward pressure against said groove to adjust the point at which said deformable spark plug becomes permanently deformed.

7. A deformable spark plug as recited in claim 6 further comprising at least one strut extending across said groove and attached to said housing at each end of said strut.

8. A deformable spark plug as recited in claim 6 in which said strut is preloaded in tension across said groove whereby said preloading assists in the determination of said cylinder pressure at which said deformable spark plug becomes permanently deformed.

9. A deformable spark plug as recited in claim 6 in which said strut is preloaded in compression across said groove whereby said preloading assists in the determination of said cylinder pressure at which said deformable spark plug becomes permanently deformed.

10. A deformable spark plug as recited in claim 1 in which said selectively weakened areas comprise at least one blind hole formed in said housing.

11. A deformable spark plug as recited in claim 1 in which said central portion is physically interconnected with said housing in the vicinity of said airtight seal, said housing having a portion extending above said airtight seal, said portion extending above said airtight seal being selectively weakened whereby said housing will deform and release said central portion upon encountering said predetermined higher than normal operating pressure in said airspace.

12. A deformable spark plug for attachment to a cylinder of an internal combustion engine comprising:

a housing and a central portion;

said housing including means for attaching said spark plug to said cylinder;

said central portion being connected to said housing, said connection comprising an airtight seal such that an airspace is formed between said housing and said central portion, said airspace being open to said engine cylinder such that pressures in said airspace are substantially equal to pressures in said cylinder; and, said airtight seal being permanently deformable whereby said airtight seal will become permanently deformed to provide an air passage through said housing to release pressure upon encountering predetermined pressures in said airspace.

13. A deformable spark plug as recited in claim 12 wherein said connection further comprises a shear ring held between said central portion and said housing, whereby said shear ring will disintegrate upon encountering sufficient upward force of said central portion and release said central portion to create an air passage between said cylinder and ambient air.

14. A spark plug for attachment to a cylinder of an internal combustion engine comprising:

A housing and a central portion;

said housing including means for attaching said spark plug to said cylinder;

said central portion being connected to said housing, said connection comprising an airtight seal between said central portion and said housing;

said connection further comprising a shear ring held between said central portion and said housing, whereby said shear ring will disintegrate upon encountering sufficient upward force of said central portion and release said central portion to create an air passage between said cylinder and ambient air;

said central portion having a lower end that is exposed to cylinder pressure whereby said central portion will be forced upward upon encountering greater than normal cylinder pressure.

15. A spark plug for attachment to a cylinder of an internal combustion engine comprising:

A housing and a central portion;

said housing including means for attaching said spark plug to said cylinder;

said central portion being connected to said housing, said connection comprising an airtight seal between said central portion and said housing;

said central portion having a lower end that is exposed to cylinder pressure;

a hollow channel being located substantially within the junction between said housing and said central portion, said channel having one terminus at said lower end of said central portion and having a second terminus at an inner sidewall of said housing whereby cylinder pressure is communicated to said inner sidewall.

16. A spark plug for attachment to a cylinder of an internal combustion engine comprising:

A housing and a central portion;

said housing including attachment means for attaching said spark plug to said cylinder;

said attachment means being deformable to release said spark plug upon encountering cylinder pressure falling within a range that is greater than normal operating pressure and lower that the pressure at which engine failure will occur.

* * * * *

UNITED STATES PATENT AND TRADEMARK OFFICE

CERTIFICATE OF CORRECTION

PATENT NO. : 5,873,340
DATED : February 23, 1999
INVENTOR(S) : J. Michael Shifflette It is certified that error appears in the above-identified patent and that said Letters Patent is hereby corrected as shown below:

Column 9,
Delete lines 11 through 67 (claims 1-9).

Delete columns 10, 11 and 12 (claims 10-16).

Replace the foregoing with new claims 1-15 as follows:

1. A deformable plug for attachment to a pressure vessel, said plug comprising:
a housing and a central portion;
said housing including a housing wall having an outer surface and an inner surface;
said outer surface including means for securing said housing to said pressure vessel;
said inner surface of said housing wall extending around and contacting said central portion to form an airtight seal between said inner surface and said central portion;
said inner surface and said central portion forming an airspace around said central portion below said airtight seal;
said airspace being in fluid communication with the interior of said pressure vessel to experience pressure substantially equal in pressure within the pressure vessel;
said housing wall including one or more selectively weakened areas above said securing means; and,
said selectively weakened areas being deformable to create an air passage through said housing above said securing means upon the introduction of a predetermined higher than normal pressure into said airspace whereby said predetermined higher than normal pressure is released to an area of relatively lower pressure, said predetermined higher than normal pressure falling within a range that is greater than normal pressure and lower than the pressure at which pressure vessel failure will occur.
2. A deformable plug according to claim 1, wherein said selectively weakened area comprise a groove defined by said outer wall of said housing.
3. A deformable plug according to claim 2, wherein said groove is circumferentially disposed around said housing.
4. A deformable plug as according to claim 3, wherein said groove comprises a channel having a generally rectangular cross-section.
5. A deformable plug according to claim 3, wherein said groove comprises a channel having a rounded surface.

UNITED STATES PATENT AND TRADEMARK OFFICE

CERTIFICATE OF CORRECTION

PATENT NO. : 5,873,340
DATED : February 23, 1999
INVENTOR(S) : J. Michael Shifflette It is certified that error appears in the above-identified patent and that said Letters Patent is hereby corrected as shown below:

6. A deformable plug according to claim 3, further including a cable at least partially disposed within said groove, said cable extending circumferentially around at least a portion of said housing wall, one end of said cable and the other end of said cable being attached to said outer wall of said housing on opposite sides of said groove, said cable being selectably tensionable whereby said cable provides inward pressure within said groove to adjust the point at which said deformable spark plug becomes deformed.
7. A deformable plug according to claim 3, further including at least one strut extending across said groove and having opposing ends attached to said housing.
8. A deformable plug according to claim 7, wherein said strut is preloaded in tension across said groove whereby said preloading assists in the determination of said vessel pressure at which said deformable plug becomes deformed.
9. A deformable plug according to claim 7, wherein said strut is preloaded in compression across said groove whereby said preloading assists in the determination of said vessel pressure at which said deformable plug becomes deformed.
10. A deformable plug according to claim 1, in which said selectively weakend areas comprise at least one blind hole formed in said housing.
11. A deformable plug according to claim 1, wherein said central portion is physically interconnected with said housing in the vicinity of said airtight seal, said housing having a portion extending above said airtight seal, said portion extending above said airtight seal being selectively weakend whereby said housing will defom and release said central portion upon encountering said predetermined higher than normal operating pressure in said airspace.
12. A deformable plug, such as a spark plug or glow plug, for attachment to a cylinder of an internal combustion engine comprising:
a housing and a central portion;
said housing including means for attaching said plug to the cylinder of an internal combustion engine;
said central portion being connected to said housing in an airtight manner, said housing and said central portion forming an air space, said airspace being open to the engine cylinder such that pressures in said airspace are substantially equal to pressures in the cylinder; and,
said housing being deformable in response to cylinder pressure whereby said housing ceases to be connected to said central portion in an airtight manner thereby providing an air passage through said housing to release pressure upon encountering predetermined pressures in said airspace.
13. A deformable spark plug according to claim 12, wherein said connection further comprises a shear ring held between said central portion and said housing, whereby said shear ring will disintegrate upon encountering sufficient upward force of said central portion and release said central portion to create an air passage between said cylinder and ambient air.

UNITED STATES PATENT AND TRADEMARK OFFICE

CERTIFICATE OF CORRECTION

PATENT NO. : 5,873,340
DATED : February 23, 1999
INVENTOR(S) : J. Michael Shifflette It is certified that error appears in the above-identified patent and that said Letters Patent is hereby corrected as shown below:

14. A spark plug for attachment to a cylinder of an internal combustion engine comprising:
a housing and a central portion;
said housing including means for attaching said spark plug in communication with the cylinder;
said central portion being connected to said housing, said connection comprising an airtight seal between said central portion and said housing;
said central portion having a lower end that is exposed to cylinder pressure whereby said central portion will be forced upward upon encountering greater than normal cylinder pressure;
said connection further including a shear ring disposed between said central portion and said housing, whereby greater than normal cylinder pressure will result in sufficient upward force on said central portion such that said shear ring will release said central portion to create an air passage between the cylinder and ambient air.

15. A spark plug for attachment to a cylinder of an internal combustion engine comprising:
a housing and a central portion;
said housing including means for attaching said spark plug to the cylinder;
said central portion being connected to said housing, said connection forming an airtight seal between said central portion and said housing;
said central portion having a portion thereof that is exposed to cylinder pressure;
a hollow channel being located substantially within the junction between said housing and said central portion, said channel having one terminus at said lower end of said central portion and having a second terminus at an inner sidewall of said housing whereby cylinder pressure is communicated to said inner sidewall.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*